United States Patent [19]

Sasaki et al.

[11] 4,174,414

[45] Nov. 13, 1979

[54] PRODUCTION OF SYNTHETIC SUEDE LEATHER

[75] Inventors: Toshimitsu Sasaki; Keikichi Fujita, both of Sennan; Hajime Ito, Izumisano, all of Japan

[73] Assignee: Toyo Cloth Co. Ltd., Sennan, Japan

[21] Appl. No.: 804,604

[22] Filed: Jun. 8, 1977

[30] Foreign Application Priority Data

Apr. 20, 1977 [JP] Japan ..... 52/46093

[51] Int. Cl.[2] ..... B32B 5/18; B32B 27/40; B32B 31/18

[52] U.S. Cl. ..... 428/85; 156/77; 156/254; 156/331; 428/91; 428/286; 428/425; 428/904

[58] Field of Search ..... 156/254, 61, 331, 77; 428/904, 91, 85, 286, 425

[56] References Cited

U.S. PATENT DOCUMENTS

| | | | |
|---|---|---|---|
| 2,351,498 | 6/1944 | Fowler | 156/254 X |
| 3,540,916 | 11/1970 | Fukuda et al. | 428/904 X |
| 3,567,535 | 3/1971 | Noda et al. | 156/77 |
| 3,616,023 | 10/1971 | Fukushima et al. | 156/247 X |
| 3,714,307 | 1/1973 | Shikada | 428/904 X |
| 3,912,840 | 10/1975 | Edberg | 428/904 X |
| 3,922,402 | 11/1975 | Shimamura et al. | 428/904 X |
| 3,958,057 | 5/1976 | Nishimura et al. | 428/904 X |
| 4,072,773 | 2/1978 | Fukushima | 428/904 X |

*Primary Examiner*—Michael G. Wityshyn
*Attorney, Agent, or Firm*—Haight & Huard

[57] ABSTRACT

Synthetic suede leather is produced by casting a mixture containing polyurethane elastomer and a solvent therefor between two sheets of a substrate fabric, immersing the resulting structure in a liquid which is a nonsolvent for polyurethane elastomer but miscible with said solvent, splitting said structure into two sheets at middle of the cast layer before it is fully gelled, and re-immersing the resultant sheets in said nonsolvent to allow complete gelation of said mixture.

11 Claims, No Drawings

PRODUCTION OF SYNTHETIC SUEDE LEATHER

This invention relates to the production of synthetic suede leather.

It is known to produce synthetic leather by casting a solution containing polyurethane elastomer onto a substrate, immersing the resultant structure in a bath of a liquid which is non-solvent for the polymer but miscible with the solvent used for making the solution to form a microporous layer of the polyurethane elastomer. Suede-like sheet material is obtained by splitting the resultant structure at or near the middle of the polymer layer into two sheets, one having the substrate and the other having no backing which is subsequently laminated to a suitable support with the split side thereof exposed outwardly. Splitting in this way results in uneven thickness of the microporous polyurethane layer and causes transfer of color of the polymer layer when it is buffed or polished. This is because splitting is carried out after the polymer layer has been fully cured and the split layer does not have any protective, less porous layer on the top surface.

Sometimes splitting in this way may cause complete stripping of the entire polymer layer from the substrate.

When the split layer is laminated to a suitable backing, it is often seen that the solvent used in the adhesive penetrates into the interior and thus destroys the cellular texture of the microporous polymer layer.

It is also known to produce sheet materials like a raised fabric by sandwiching a porous thermoplastic layer between two sheets of substrate fabric, heating the thermoplastic layer to the melting point thereof, pulling the substrate fabrics in opposite directions so that the molten thermoplastic layer is stretched in a direction perpendicular to the substrate sheet, then cutting and splitting the entire structure into two sheets at the middle of the thermoplastic layer. Such sheet materials have an appearance similar to raised fabric and the physical properties thereof are not suited for a leather substitute.

It is a primary object of the invention to provide a method of the production of synthetic suede leather which is superior in physical properties to prior art synthetic suede leather and which is resistant to color transfer in use or during post-treatment steps.

It is another object of the present invention to provide an economical, relatively simple method for producing synthetic suede leather having the appearance and feeling similar to natural suede leather.

According to the present invention, a method for the production of synthetic suede leather is provided which comprises casting a layer of a mixture containing polyurethane elastomer and a solvent therefor between two sheets of substrate fabric, immersing the resultant structure in a liquid which is nonsolvent for the polyurethane elastomer, but miscible with said solvent, until only a part of said solvent originally present in the cast layer is replaced by said nonsolvent and the interior of said layer is not fully gelled, splitting the treated structure into two sheets near the middle of the polyurethane elastomer layer, reimmersing said split sheets in said nonsolvent to allow complete gelation of said polyurethane layer and then drying said sheets.

The polyurethane elastomers which may be used in the method of this invention are those generally known as "polyurethane", "polyurethaneurea elastomer" or "polyurea elastomer". The elastomers are produced by reacting a diisocyanate compound with a polyalkylenetherglycol or polyester having terminal hydroxy groups and then chain-extending the resulting polymer or prepolymer with a chain-extending agent having two active hydrogen atoms in the molecule.

The polyalkylenetherglycols used in the above reaction preferably have a molecular weight from 300 to 5,000 more preferably from 400 to 2,000, and include, for example, polyethylenetherglycol, polypropylenetherglycol, polytetramethylenetherglycol, polyhexamethylenetherglycol, polynonamethylenetherglycol, polydecamethylenetherglycol, polydodecamethylenetherglycol or mixtures thereof.

The polyalkylenetherglycol may be replaced partly or wholly by a polyester of a monomeric or polymeric diol with a dibasic carboxylic acid.

Examples of the diisocyanate compound include aliphatic diiosocyanates such as 1,6-hexamethylenediisocyanate, cycloaliphatic diisocyanates such as 1,4-cyclohexylenediisocyanate, and aromatic diisocyanates such as 4-methyl-m-phenylenediisocyanate, 4,4'-biphenylendiisocyanate or methylenebis(4-phenylisocyanate).

Examples of the chain-extending agent include hydrazine, ethylenediamine, propylenediamine, water, ethyleneglycol, diethyleneglycol, propyleneglycol and the like.

Reaction between the diisocyanate compound and the polyalkylenetherglycol and/or polyester is carried out at such a molar ratio that the isocyanate groups are fully reacted and the resultant polyurethane is free from terminal isocyanate group. An average molecular weight of the polyurethane elastomer ranging from 30,000 to 100,000 is preferable.

The resultant polyurethane elastomer may be dissolved in an organic solvent such as dimethylformamide, dimethylacetamide, tetrahydrofuran, tetramethylurea or dioxane. The solution may optionally contain another polymeric material such as polyamide, polyester, polyacrylonitrile, polyvinylchloride, vinylchloride-vinylacetate copolymer, butadiene-acrylonitrile copolymer, butadiene-styrene copolymer, chloroprene rubber or polyisobutylene rubber. The amount of these polymers is preferably less than 30% by weight of the polymer mixture.

Addition of these polymers to the polyurethane elastomer may improve flexibility and permeability of moisture.

The solution may optionally contain a pore-producing agent which is insoluble in the solvent used in making the polymer solution, but leachable with the nonsolvent of the polymer.

Examples of such pore-producing agents include sodium carbonate, sodium bicarbonate, ammonium bicarbonate, sodium sulfate, polyvinylalcohol and starch. They preferably have a particle size from 30 to 500 mesh. At an amount of 50 to 1000 parts by weight, preferably from 200 to 500 parts by weight to 100 parts of the polymer, the addition of such pore-producing agent may improve splittability, softness and permeabity to moisture of the resultant synthetic suede leather.

Other additives which may be optionally incorporated in the polyurethane solution include a surface active agent such as sulfonates, polyol esters, fatty acid esters or anionic surfactants, a colorant such as pigments or dyes, a filler such as calcium carbonate, talc or clay and a cross-linking agent such as masking isocyanate.

Consistency of the polyurethane elastomer in the mixture is preferably from 6 to 25% by weight, more preferably from 10 to 15% and the consistency of the total solid content thereof is generally from 6 to 80% by weight. The consistency is adjusted to a suitable viscosity depending upon the mode of application of the mixture onto the substrate fabric such as woven or nonwoven fabrics, knitted fabrics, or raised fabrics. The substrate fabric may be preliminarily impregnated or precoated with a resin or synthetic rubber.

The casting mixture may be cast between two sheets of the substrate in any conventional manner. For example, the solution is applied onto the substrate by a doctor knife, roller coater, reverse roller coater or extruder and then two sheets of the coated fabric are laminated together in face-to-face relation so that the coating layers are incorporated together into a unitary layer. Alternatively, the mixture may be cast by spreading the same between two sheets of the substrate and passing the sheets through the nip between a pair of clearance rollers. The amount of coating is preferably from 50 to 250 g/m$^2$, more preferably from 80 to 200 g/m$^2$ in terms of the polymer content on dry basis.

The resultant structure is then immersed in a bath of a liquid which is nonsolvent for the polymer, but miscible with the solvent used in making the solution. Examples of such nonsolvent include water, ethanol, ethyleneglycol, glycerol, acetone, methyl ethyl ketone, ethyl acetate or aqueous mixtures thereof. The nonsolvent may optionally contain a solvent for the polymer up to 30% by weight.

This decreases the gelling speed of the polyurethane layer and enables to control of degree of the gelation to a desired level.

When the laminated structure is immersed in the nonsolvent, the nonsolvent will penetrate into the coating layer through the substrate and replace the solvent present in the coating layer to allow gelation of the polyurethane elastomer. Since the gelation begins from the exterior of the coating layer and proceeds toward the interior thereof, the laminated structure may be easily split at or near the middle of the coating layer to give two identical sheets by pulling both substrate fabrics to opposite directions when the middle of the coating layer is not fully gelled. The splitting is carried out preferably when from about 30 to about 85% by weight of the solvent originally present in the coating layer remains unreplaced. Since the middle of the coating layer is still sufficiently tacky within said range of the replacement, a fibrous pattern or texture similar to natural suede leather is formed on the split surface. The residual amount of solvent may easily determined by analyzing the nonsolvent, for example, by gas-chromatography. This first immersion is preferably carried out at a temperature below 60° C. to avoid rapid leaching of the pore-producing agent.

Alternatively this partial gelling may be carried out by spaying the nonsolvent onto the fabric on both sides of the laminated structure to obtain a desired level of gelation.

The resulting two identical sheets are re-immersed in a nonsolvent bath, which may be the same or different as the nonsolvent used in the first treatment, to allow complete gelation of the polyurethane elastomer. The second treatment with the nonsolvent may be preferably carried out at a temperature from 40° to 100° C. for about 5 to about 60 minutes.

After the polymer layer has been fully gelled and the pore-producing agent has been leached out, the sheet material is dried, preferably at a temperature from 70° to 120° C.

The resultant synthetic suede leather may be, if desired, subjected to a post-treatment such as softening treatment with polyols and the like, water-proofing treatment with paraffin and silicon or embossing.

The finished product has an appearance and feeling similar to those of natural suede leather. Other characteristics such as softness and breathability are also excellent.

Particularly, splitting and reimmersion in accordance with the method of the present invention give a relatively long and fine fibrous texture and a less porous skin layer on the split surface which is resistant to decreases in color transfer caused by friction.

The finished synthetic suede leather thus produced may be used as materials for the production of clothing, bags, shoes and the like.

The following examples illustrate the invention.

All parts and per cent therein are by weight unless otherwise indicated.

EXAMPLE 1

A mixture having the following composition was prepared.

| | |
|---|---|
| Polyester type polyurethane (RESAMIN CU 520, sold by Dainichiseika Kogyo average M.W. = 90,000) | 100 parts |
| Sodium hydrogen carbonate | 250 parts |
| Pigment | 20 parts |
| Dimethylformamide | 350 parts |

The above mixture was cast between two sheets of polyestercotton raised fabric at the rate of 1000 g/m$^2$. The resultant sheet was immersed in water at 30° C. until the residual amount of the solvent in the cast layer reached 70% and then split into two identical sheets at the middle of the cast layer. The split sheets were reimmerced in water at 60° for 45 minutes to remove the solvent and sodium bicarbonate therefrom and then dried at 120° C.

On the polyurethane elastomer layer was applied a polyol type surfactant and methylhydrogensiloxane at the rate of 10 g/m$^2$ and 5 g/m$^2$ respectively. The resulting sheet, which is suitable for the manufacture of clothing and bags, possessed an appearance similar to natural suede leather.

The synthetic suede leather possessed a permeability to water vapor (JIS-Z-0208) of 1,400 g/m$^2$/24 hours at a relative humidity of 90%, a scratch resistance of 800 g/mm$^2$ and a flex resistance at −5° C. of greater than 10$^5$ times. Resistance to frictional color transfer was grade 5 in dry and grade 4 in wet when the synthetic suede leather was tested by the applicable testing method according to JIS-K-6772.

In the above test, scratch resistance was determined with a Clemense scratch tester by travelling a pointed needle of 1 mm$^2$ area on the test piece at a linear speed of 1 m/minute.

The resistance is represented in terms of the minimal load in g/mm$^2$ applied to the needle to destroy the surface structure.

Flex resistance was determined by securing a test piece of 40×40 mm size between two grip means and reciprocating one of the grip means for a length of 200 mm at a reciprocation speed of 220 times/minute. The flex resistance is represented in terms of times of reciprocation when the first crack has developed on the surface.

EXAMPLE 2

The procedure of Example 1 was repeated using various amounts of residual solvent. Properties of the resulting synthetic suede leather are shown in the following table.

| Amount of residual solvent, % | Surface texture | Frictional color transfer dry | Frictional color transfer wet |
|---|---|---|---|
| 95 | not cellular | | — |
| 85 | less cellular | — | — |
| 75 | good | grade 5 | grade 4 |
| 65 | good | grade 5 | grade 4 |
| 55 | good | grade 5 | grade 4 |
| 40 | Slightly short in fibrous size | grade 4 | grade 3 |
| 20 | good | grade 4 | grade 2 |
| 0 | Short in fibrous size, uneven thickness | grade 4 | grade 2 |

EXAMPLE 3

A mixture having the following composition was prepared.

| | |
|---|---|
| Polyester type polyurethane (RESAMIN CU 89, sold by Dainichiseika Kogyo average M.W. = 100,000) | 90 parts |
| Polyvinylchloride(average M.W. = 1,000) | 10 parts |
| Ammonium bicarbonate | 300 parts |
| Pigment | 15 parts |
| Calcium carbonate | 10 parts |
| Dimethylformamide | 500 parts |

A raised cotton fabric or nylon knitting was used as a substrate. Onto the substrate was applied at one side a coating solution of polyurethane elastomer at the rate of 10 g/m$^2$ on dry basis and then dried.

Onto the coated side of the substrate was cast the above casting mixture at the rate of 750 g/m$^2$ on a wet basis and two sheets of the resultant substrate were laminated together with the respective cast layers facing inwardly.

The resultant structure was immersed in water at 30° C. until the residual amount of the solvent in the cast layer reached 67% and then split into two identical sheets at the middle of the cast layer. The split sheets were re-immersed in water at 70° C. for 30 minutes to remove the solvent and ammonium bicarbonate therefrom and then dried at 120° C.

The resulting synthetic suede leather thus produced possessed fibrous texture of relatively long size and an appearance similar to natural suede leather. Some important properties thereof are as follows:

| | |
|---|---|
| Permeability to water vapor, at 90% R.H. | 1700 g/m$^2$/24 hours |
| Scratch resistance | 800 g/mm$^2$ |
| Flex strength at − 5° C. | >10$^5$ times |
| Frictional color transfer, | grade 5(dry) |
| -continued | |
| | grade 4(wet) |

The product made from cotton woven fabric is suitable for the manufacture of bags and that made from nylon knitting is suitable for clothing.

EXAMPLE 4

The following casting mixture was prepared.

| | |
|---|---|
| Polyester type polyurethane RESAMIN CU 89, average M.W. = 100,000) | 100 parts |
| Sodium bicarbonate | 300 parts |
| Pigment | 15 parts |
| Dimethylformamide | 400 parts |

The above mixture was cast between two sheets of a rayon-vinylon woven fabric at the rate of 1,400 g/m$^2$ on a wet basis. The resultant structure was immersed in water at 18° C. for 7 minutes and then split into two sheets near the middle of the semi-gelled cast layer. The split sheets are re-immersed in water at 70° C. for 30 minutes to remove the solvent and sodium bicarbonate and dried at 120° C. On the polyurethane elastomer layer was applied a polyol typed surfactant and methylhydrogensiloxane at the rate of 5 g/m$^2$ and 3 g/m$^2$ respectively. The resultant sheet, which is suitable for the manufacture of clothing, possessed an appearance similar to natural suede leather. Some important properties thereof are as follows:

| | |
|---|---|
| Permeability to water vapor at 90% R.H., | 1500 g/m$^2$ |
| Scratch resistance | 700 g/m$^2$ |
| Flex resistance at − 5° C. | >10$^5$ times |

EXAMPLE 5

The following casting mixture was prepared.

| | |
|---|---|
| Polyester typed polyurethane (RESAMIN CU 520, average M.W. = 90,000) | 30 parts |
| Dimethylformamide | 170 parts |
| Pigment | 3 parts |

Nonwoven fabric having a sheet weight of 200 g/m$^2$ was impregnated with a solution of polyurethane elastomer at the rate of 30 g/m$^2$ on a dry basis. On this subrate fabric was applied the above mixute at the rate of 1,000 g/m$^2$ on a wet basis. Another sheet of the same polyurethane-impregnated nonwoven fabric was laminated onto the cast layer. The resulting structure was immersed in water at 18° C. for 4.5 minutes and split into two sheets at the middle of the cast layer.

The respective split sheets were re-immersed in water at 50° C. for 15 minutes to remove the solvent and dried at 120° C.

The resultant sheets possessed a microporous fibrous texture similar to natural suede leather and are suitable for the manufacture of shoes.

Some important properties thereof are as follows:

| | |
|---|---|
| Permeability to water vapor at 90% R.H., | 1300 g/m$^2$/24 hours |
| Scratch resistance, | 700 g/mm$^2$ |
| Flex resistance at −5° C. | >10$^5$ times |

-continued

| | |
|---|---|
| Apparent density of polyurethane layer, | 0.5 g/cm$^2$ |

EXAMPLE 6

The following casting mixture was prepared.

| | |
|---|---|
| Polyester typed polyurethane (RESAMIN CU 520) | 85 parts |
| Vinylchloride-vinylacetate copolymer (85 : 15, average M.W. = 800) | 15 parts |
| Ammonium bicarbonate | 400 parts |
| Pigment | 15 parts |
| Dimethylformamide | 450 parts |

Raised cotton woven fabric or raised nylon knitting was used as a substrate. The substrate was coated at one side with a solution of polyurethane elastomer at the rate of 10 g/m$^2$ on a dry basis. Onto the coated side of the substrate was cast the above mixture at the rate of 500 g/m$^2$ on a wet basis. Two sheets of the substrate were laminated together with the respective cast layer facing inwardly. The resulting structure was immersed in water at 18° C. for 4 minutes and split into two sheets at the middle of the cast layer. The respective sheets were re-immersed in water at 70° C. for 15 minutes to remove dimethylformamide and ammonium bicarbonate and then dried at 120° C.

The resultant sheets possessed a relatively long fibrous structure similar to natural suede leather. The synthetic suede leather made from the cotton fabric is suitable for the manufacture of bags and that made from nylon knitting is suitable for clothing.

Some important properties thereof are as follows:

| | |
|---|---|
| Permeability to water vapor at 90% R.H., | 1,900 g/m$^2$/24 hours |
| Scratch resistance | 600 g/mm$^2$ |
| Flex resistance at −50° C. | >10$^5$ times |

It is to be understood that various modifications and substitutions may be made by those skilled in the art without departing from the novel spirit and scope of the invention.

What is claimed is:

1. A method for producing synthetic suede leather which comprises:

casting a mixture consisting essentially of a solution of polyurethane elastomer in an organic solvent therefor to form a structure comprising a layer of said solution between two sheets of a substrate fabric, immersing said structure in a liquid which is a nonsolvent for said polyurethane elastomer, but miscible with said solvent, until said solvent is only partly removed from said layer and said mixture is only partly gelled, splitting said structure into two sheets at or near the middle of said partly gelled layer, said layer being sufficiently tacky to form a fibrous pattern or texture similar to natural suede leather on each sheet, and re-immersing the resultant split sheets in said nonsolvent to complete gellation of said layer, resulting in synthetic suede leather having a long and fibrous texture.

2. The method of claim 1, wherein said mixture further contains a pore-producing agent which is insoluble in said solvent but soluble in said nonsolvent.

3. The method of claim 2, wherein said pore-producing agent is selected from the group consisting of sodium carbonate, sodium bicarbonate, ammonium bicarbonate, sodium sulfate, polyvinylalcohol and starch.

4. The method of claim 3, wherein said pore-producing agent has a particle size from 30 to 500 mesh.

5. The method of claim 1, wherein said solvent is selected from the group consisting of dimethylformamide, dimethylacetamide, tetrahydrofuran, tetramethylurea and dioxane, and said nonsolvent is selected from the group consisting of ethanol, ethylene glycol, glycerol, acetone, methyl ethyl ketone, ethyl acetate, aqueous mixtures thereof and water.

6. The method of claim 1, wherein said structure to be split contains from 30 to 85% by weight of the solvent originally present in said mixture.

7. The method of claim 1, wherein said mixture is cast at the rate of 50 to 250 g/m$^2$ on a dry basis.

8. The method of claim 1, wherein said solvent is dimethylformamide and said nonsolvent is water.

9. The method of claim 8, wherein said nonsolvent is kept at a temperature below 60% for the first immersion and at a temperature from 40° to 100° C. for the second immersion.

10. Synthetic suede leather produced by the method of claim 1.

11. Synthetic suede leather produced by the method of claim 2.

* * * * *

UNITED STATES PATENT AND TRADEMARK OFFICE

CERTIFICATE OF CORRECTION

PATENT NO. : 4,174,414

DATED : November 13, 1979

INVENTOR(S) : Toshimitsu Sasaki et al.

It is certified that error appears in the above-identified patent and that said Letters Patent are hereby corrected as shown below:

Claim 9 should read as follows:

9. The method of claim 8, wherein said nonsolvent is kept at a temperature below 60°C for the first immersion and at a temperature from 40° to 100°C for the second immersion.

Signed and Sealed this

*Twelfth* Day of *February 1980*

[SEAL]

*Attest:*

SIDNEY A. DIAMOND

*Attesting Officer*

*Commissioner of Patents and Trademarks*